US006354487B1

(12) United States Patent
Muise, Jr.

(10) Patent No.: US 6,354,487 B1
(45) Date of Patent: Mar. 12, 2002

(54) STACKABLE COVERED TRAY

(75) Inventor: H. Donald Muise, Jr., Mira Loma, CA (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 09/829,559

(22) Filed: Apr. 9, 2001

Related U.S. Application Data

(60) Provisional application No. 60/195,617, filed on Apr. 7, 2000.

(51) Int. Cl.[7] ..... B65D 5/32

(52) U.S. Cl. ..... 229/125.28; 206/508; 206/511; 229/125.29; 229/915

(58) Field of Search ..... 229/125.28, 125.29, 229/915, 916; 206/508, 509, 511

(56) References Cited

U.S. PATENT DOCUMENTS

| | | | | |
|---|---|---|---|---|
| 1,997,909 A | | 4/1935 | Luce | |
| 2,561,979 A | | 7/1951 | George | |
| 2,618,429 A | | 11/1952 | Donnell | |
| 2,706,595 A | | 4/1955 | Fallert | |
| 2,711,281 A | | 6/1955 | Argodale | |
| 2,858,059 A | | 10/1958 | Kitchell | |
| 2,894,672 A | | 7/1959 | Bamburg | |
| 2,944,727 A | | 7/1960 | Moore | |
| 3,486,680 A | * | 12/1969 | Negus, Jr. | 229/125.29 |
| 4,163,494 A | | 8/1979 | Stollberg | |
| 4,567,996 A | | 2/1986 | Muise | |
| 4,807,756 A | * | 2/1989 | Young et al. | 206/509 |
| 4,984,734 A | * | 1/1991 | Zion et al. | 229/915 |
| D348,607 S | | 7/1994 | Young | |
| 5,335,844 A | | 8/1994 | Young | |
| 5,390,847 A | | 2/1995 | Young | |
| 5,402,930 A | * | 4/1995 | Storms et al. | 229/125.28 |
| 5,573,175 A | | 11/1996 | Straub et al. | |
| 6,027,017 A | * | 2/2000 | Kuhn et al. | 229/125.28 |

FOREIGN PATENT DOCUMENTS

| | | | | |
|---|---|---|---|---|
| CA | 639448 | | 4/1962 | |
| DE | 40 03 104 A1 | | 8/1991 | |
| DE | 40 03 104 C2 | | 11/1996 | |
| EP | 548879 A1 | * | 6/1993 | 229/125.29 |
| GB | 528289 | | 10/1940 | |

* cited by examiner

*Primary Examiner*—Gary E. Elkins
(74) *Attorney, Agent, or Firm*—Christensen O'Connor Johnson Kindness PLLC

(57) ABSTRACT

A combined stacking tab is provided for use with a container having a containment portion and a lid. The containment portion includes a lateral panel and an upright wall. The upright wall includes an upper edge with a stacking tab. The lid also includes a lateral panel and an upright wall connected to the lateral panel. A lid stacking tab is cut from portions of the lid lateral panel at its connection to the lid upright wall, thereby resulting in an opening in the lid lateral panel. As erected, the lid stacking tab remains in the plane of the lid upright wall, with the containment portion stacking tab being located within the opening of the lid lateral panel. The combination of the containment portion stacking tab and the lid stacking tab forms a combined stacking tab of at least double-ply material thickness.

30 Claims, 8 Drawing Sheets

STACKABLE COVERED TRAY

CROSS-REFERENCE TO RELATED APPLICATION

The present application stems from U.S. Provisional Application No. 60/195,617, filed Apr. 7, 2000, the benefit of which is hereby claimed under 35 U.S.C. §119(e).

FIELD OF THE INVENTION

The present invention relates to containers, and more particularly, to paperboard containers having stacking tabs and mating openings for maintaining adjacent containers in an aligned, stacked arrangement.

BACKGROUND OF THE INVENTION

Various types of stacking tabs are known for use with paperboard containers, and especially produce trays. These tabs help maintain the alignment of stacked containers during shipping and also contribute to maintaining the integrity of the containers as a single unit.

In prior designs, stacking tabs are generally formed along an upper edge of a tray's end wall. A lower opening is formed in the tray bottom surface to receive the stacking tab of an adjacent underlying tray.

Known stacking tabs having a number of disadvantages. Generally, the problem has been in finding ways to increase the strength of the tabs without undue losses in container production efficiency or increases in material waste. Some designers include metal stacking wires to improve their strength, while others use a folded-over double-ply paperboard tab. The insertion of metal stacking wires is a time-consuming task and not efficient for large-scale container production projects. The use of folded-over double-ply paperboard tabs is helpful, but not every container needs or can be cost-effectively produced with double-walled sides.

In one arrangement, described in U.S. Pat. No. 5,390,847, a tray is provided with a separate lid that includes secondary, triangular stacking tabs. When assembled these lid stacking tabs are exterior to the tray's end wall stacking tabs. In the '847 arrangement, however the end wall stacking tabs have a tendency to catch on objects and fold over easily. This ruins the tabs and renders them unfit for maintaining container alignment. While the lid stacking tabs are helpful to support the end wall tabs, they are insufficient to keep the edges of the end wall tabs from collapsing, either inward or outward.

Thus, a need exists for a container with side wall stacking tab arrangements that are much more resistant to folding and that can be easily and inexpensively mass produced. Ideally, the stacking tabs would be available for use with a number of known container shapes and sizes, and particularly for use with produce trays.

SUMMARY OF THE INVENTION

A combined stacking tab is provided for use with a container having a containment portion and a lid. The containment portion includes a lateral panel and an upright wall. The upright wall includes an upper edge with a stacking tab. The lid also includes a lateral panel and an upright wall connected to the lateral panel. A lid stacking tab is cut from portions of the lid lateral panel at its connection to the lid upright wall, thereby resulting in an opening in the lid lateral panel. As erected, the lid stacking tab remains in the plane of the lid upright wall, with the containment portion stacking tab being located within the opening of the lid lateral panel. The combination of the containment portion stacking tab and the lid stacking tab form a combined stacking tab of at least double-ply material thickness.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

The present invention is an improvement to containers, particularly open-faced produce trays and the like, that use stacking tabs to maintain stacked alignment. The invention also provides protection for container contents and adds structural integrity to the container. The invention further strengthens the underportion of the container and helps support containers stacked thereabove. The present invention provides a number of inventive features that increase resistance to tab folding and that can be easily and inexpensively mass produced. In addition, the present invention can be applied to a plethora of known containers with little or no alteration.

According to one aspect of the present invention, stacking tabs of a lid and a containment portion are similarly sized and shaped. According to another aspect, an outer flap of the lid is made to insert into a slot in a containment portion upright wall. According to still another aspect, the containment portion stacking tab and lid stacking tab are of differing heights so that the containment portion stacking tab may be inserted into a trapped compartment of an adjacent containment portion upright wall. According to yet another aspect, the containment portion stacking tab is made of double-ply material thickness.

Figure 1:
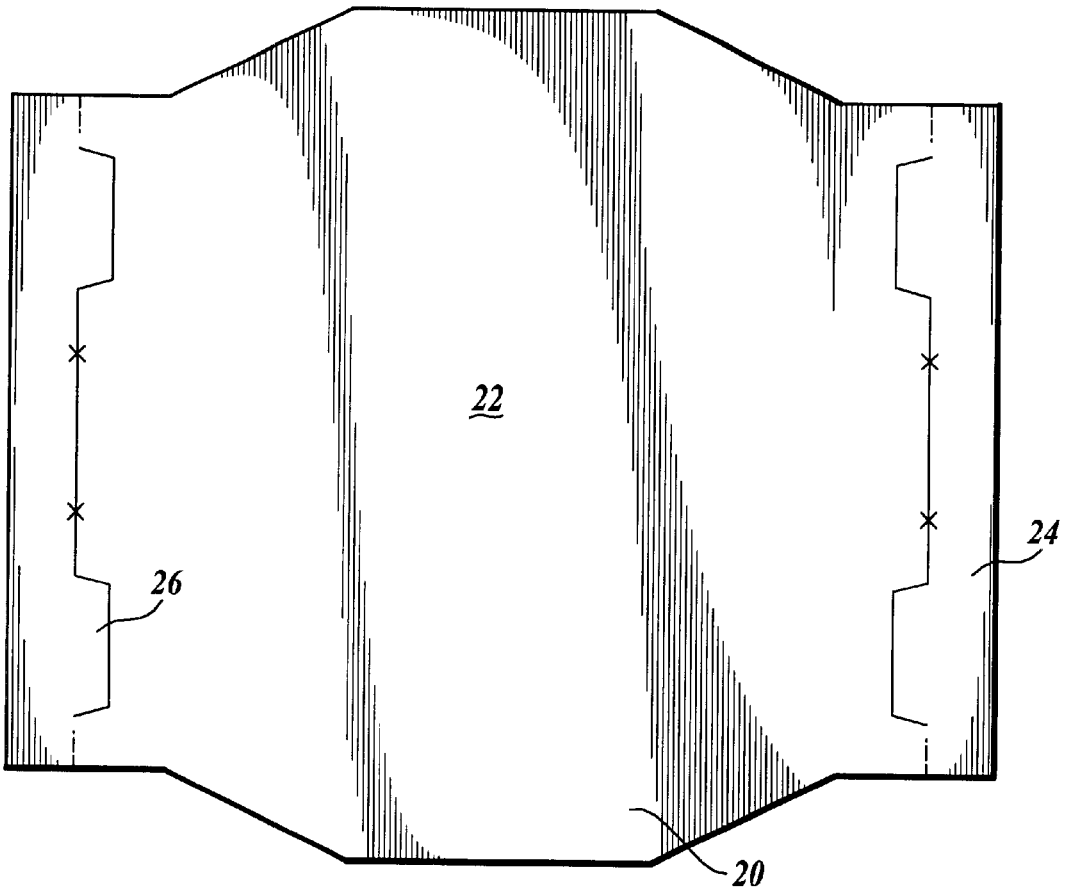
FIG. 1 is a plan view of one embodiment of a lid blank formed in accordance with the present invention.

Referring to FIG. 1, a container lid 20 formed in accordance with the present invention includes a lateral panel 22 and an upright wall 24 hingedly connected to the lid lateral panel 22. The lid 20 is for use with a containment portion 30 (usually the lower portion of the container.) A lid stacking tab 26 is formed along the hinged connection between the lid upright wall 24 and the lid lateral panel 22. The lid stacking tab 26 is cut from portions of the lid lateral panel 22 so that, when removed, an opening 28 is provided in the lateral panel 22 in place of the stacking tab 26. The opening is preferably a diecut opening. The cut may also be made to include an undercut portion (or notch-like shape) to provide a more secure attachment of the lid 20 to the containment portion 30. Depending on the number and placement of stacking tabs, the lid 20 may be foldably joined to some portion of the containment portion 30 or it may be completely separate.

The lid upright wall 24 provides resistance to bulging of the container walls and the lid lateral panel 22 helps support the bottom of an above adjacent container from excessive sagging. The lid upright wall 24 may be made to fit into a recessed area of the containment portion (e.g., between body flanges of a Bliss-style tray), into a recess manufactured into the container, or inserted into a slotted opening cut into a wide shoulder of a "rollover" type of construction such as a roll end tray, or other variation. These variations are described below.

Figure 2:
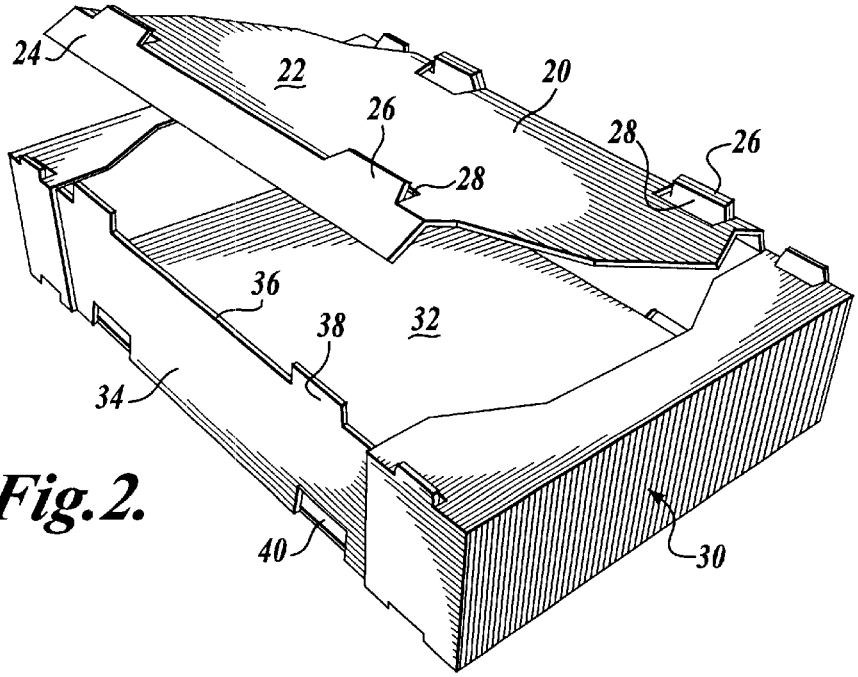
FIG. 2 is a perspective view of the lid of FIG. 1 as used with a known produce tray, shown with the lid open.

Referring to the embodiment of FIG. 2, the containment portion 30 includes a lateral panel 32 and an upright wall 34 transverse to the containment portion lateral panel. The upright wall 34 has an upper edge 36 with a stacking tab 38 provided therealong. A receiving hole 40 is formed in the containment portion along the connection of its lateral panel 32 and upright wall 34 to receive the combined stacking tab of an adjacent stacked container.

To assemble the container, the lid upright wall 24 is hinged away from the lateral panel 22, with the lid stacking tab 26 remaining in the plane of the lid upright wall 24. The containment portion stacking tab 38 is located within the lid opening 28 and aligns with the lid stacking tab 26. The combination of the containment portion stacking tab 38 and the lid stacking tab 26 forms a combined stacking tab of at least double-ply material thickness.

Figure 3:
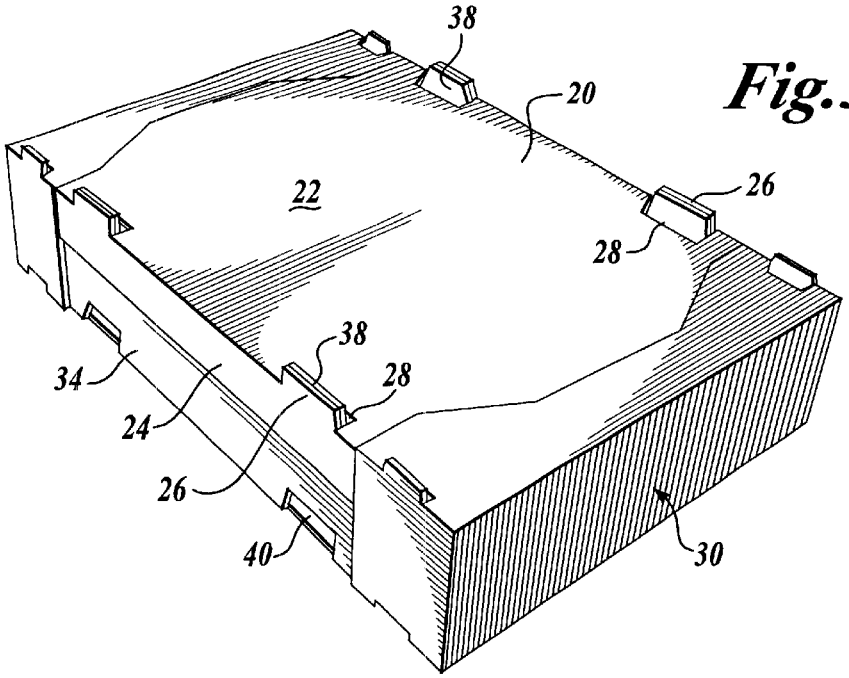
FIG. 3 is a perspective view of the combination of FIG. 2, with the lid closed.

There are a number of aspects of the present invention that may be varied to increase the tab strength. In the embodiment of FIGS. 1, 2, and 3, the lid stacking tab 26 is the same size and shape as the containment portion stacking tab 38. Thus, as assembled, the lid stacking tab 26 is completely commensurate with the containment portion stacking tab 38. This adds corner support and eliminates the likelihood that the containment portion stacking tabs will be inadvertently folded over.

Another aspect of the present invention is the size, shape, and placement of the receiving hole 40. In the embodiment of FIGS. 2 and 3, the receiving hole 40 is formed solely from portions of the containment portion upright wall 34. As assembled, the containment portion stacking tab 38 is received in the receiving hole 40 of an adjacent containment portion upright wall, with the lid stacking tab 26 exterior to the adjacent containment portion upright wall. It is preferred in such arrangements that the containment portion stacking tab 38 and receiving hole 40 have the same dimensions. This increases the friction between the parts and aids in maintaining their connection.

Figure 4:
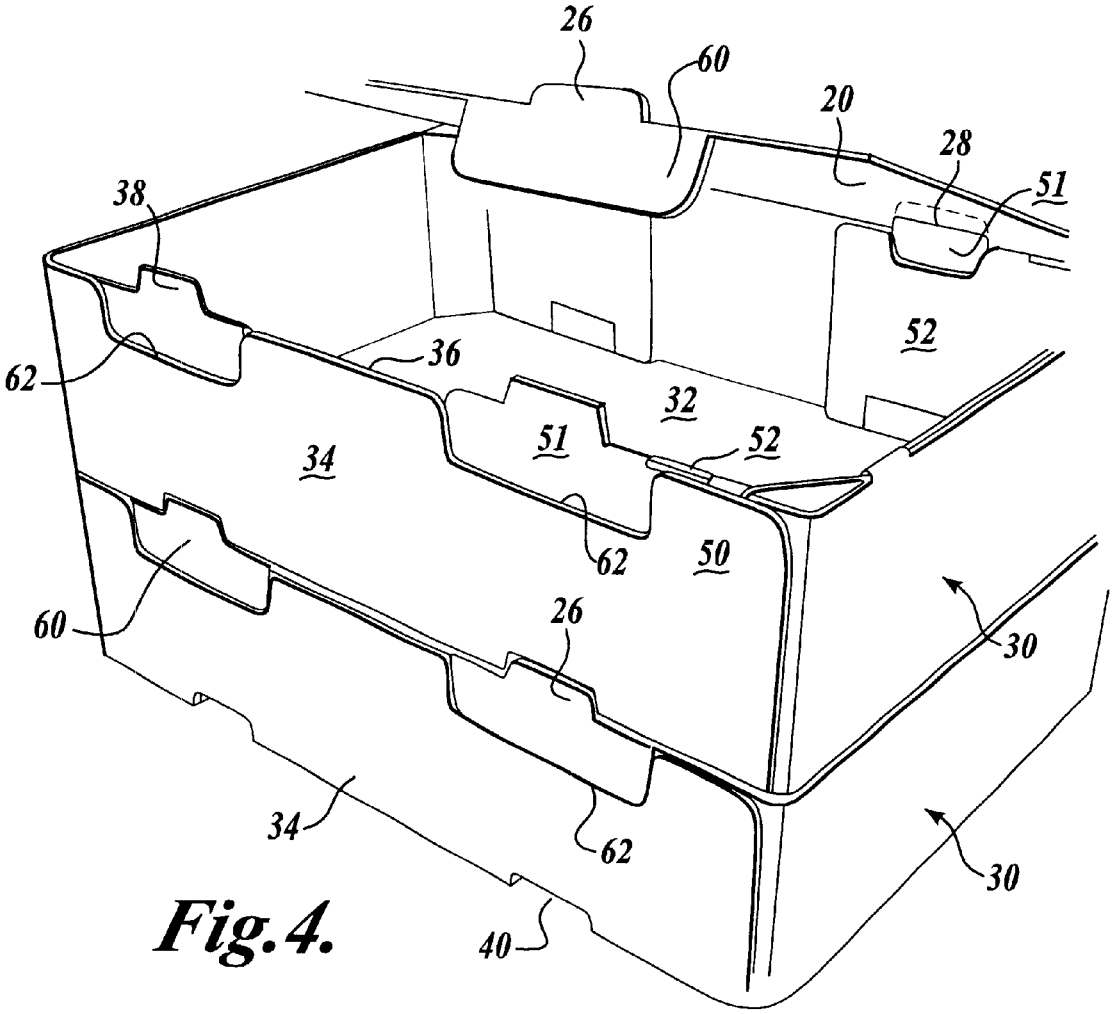
FIG. 4 is a perspective view of two stacked containers formed in accordance with the present invention.

As an alternative and referring to FIG. 4, the container may be formed such that the containment portion upright wall 34 is made of plural subpanels 50, 51, 52. As shown, an inner subpanel 52 may be made to include the containment portion stacking tab 38. By forming the receiving hole 40 in both the outer and inner subpanels 51, 52, the lid stacking tab 26 may be made to reside coplanar with the outer subpanel 50, as assembled. As shown in FIG. 4, the lid upright wall 24 is modified in the shape of an isolated flap 60 that fits securely in a matching cutout 62 along the containment portion upright wall upper edge 36. This particular arrangement has the added benefit of a smooth outer side wall and increased frictional connections between the lid and containment portion.

Figure 5:
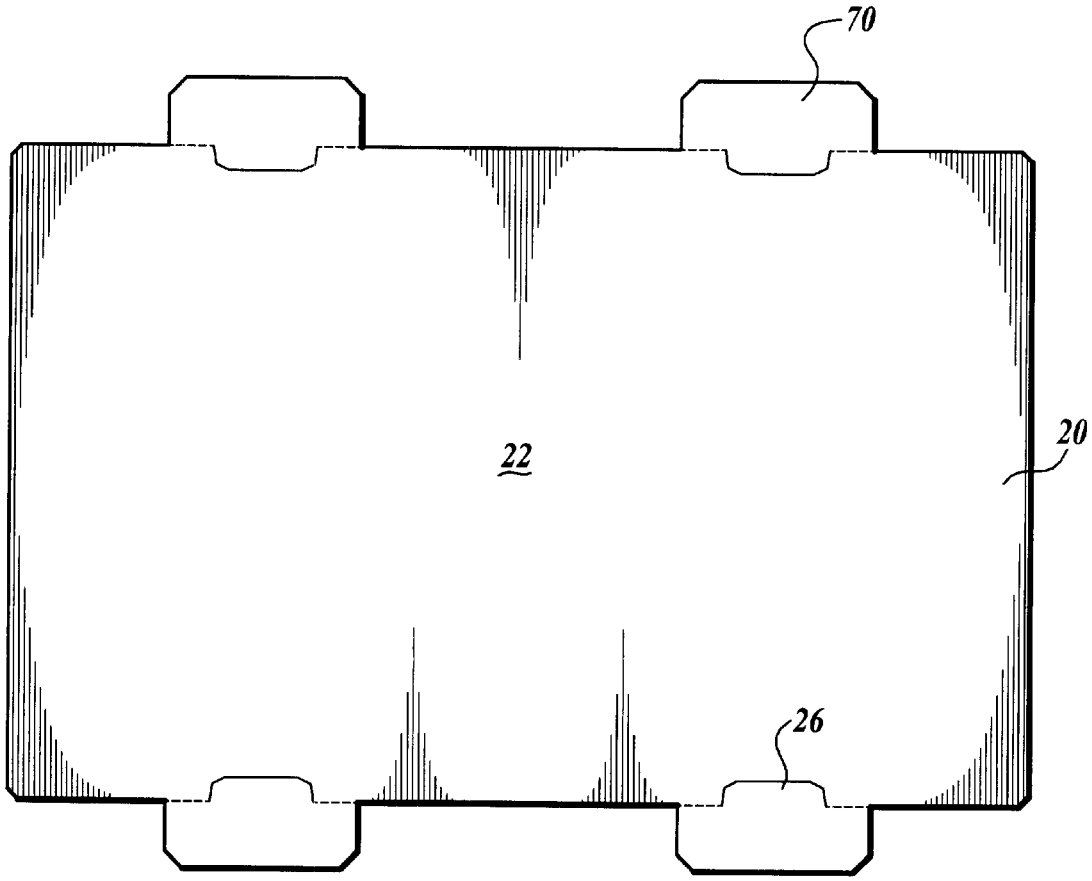
FIG. 5 is a plan view of another embodiment of a lid blank formed in accordance with the present invention.
Figure 6:
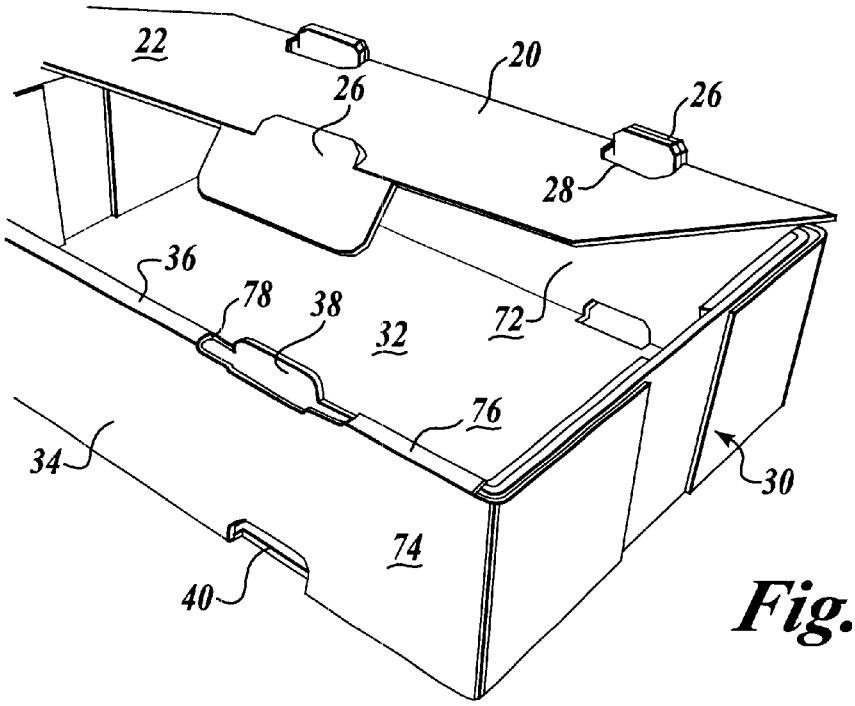
FIG. 6 is a perspective view of the lid of FIG. 5 as used in a container arrangement formed in accordance with the present invention, shown with the lid open.
Figure 7:
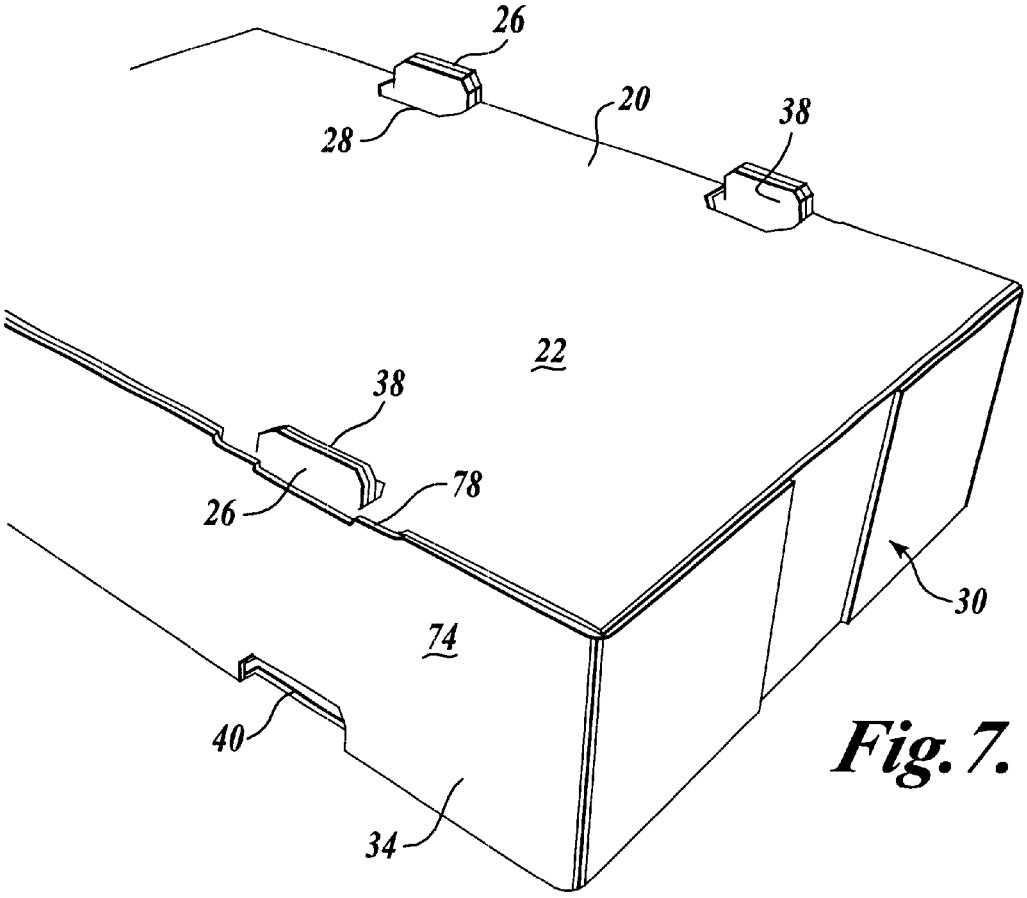
FIG. 7 is a perspective view of the combination of FIG. 6, with the lid closed.

Alternatively, the present invention may be formed such that the lid upright wall is positioned interior to the containment portion upright wall. Referring to FIG. 5, 6, and 7, the lid upright wall is formed as a smaller flap 70. The containment portion upright wall is formed as a fold-over wall of double-ply thickness. A first subpanel 72 is hinged inward from a second, outer subpanel 74. A bridge panel 76 is optionally available along its hinge line to increase the distance between the two subpanels. A slot 78 is provided in the bridge panel to accept the flap of the lid. The receiving hole 40 shown is formed in both containment portion upright wall 34 and lateral panel 32. Alternatively, the receiving hole 40 may be formed solely in the containment portion lateral panel 32.

The advantage of this arrangement is the placement of the lid upright panel inside of the exterior side wall surface. This eliminates the likelihood of the lid being inadvertently disturbed. Similarly, the embodiment shown in FIG. 9 may be made such that the lower outer subpanel of the containment portion upright wall extends upward. The lid upright wall thus inserts between the containment portion subpanels for a large part of the overall wall's width.

Another aspect of the present invention is the relative size and shape of the lid stacking tabs relative to each other and relative to the receiving hole. Referring to the embodiment of FIG. 9, the lid stacking tab is of a first height and the containment portion stacking tab is of a second height. The first height is less than the second height, so that the containment portion stacking tab appears taller. When the combined stacking tab is connected into the receiving hole of an adjacent container, the additional height of the containment portion stacking tab is available to push outward against the adjacent containment portion upright wall.

Figure 9:
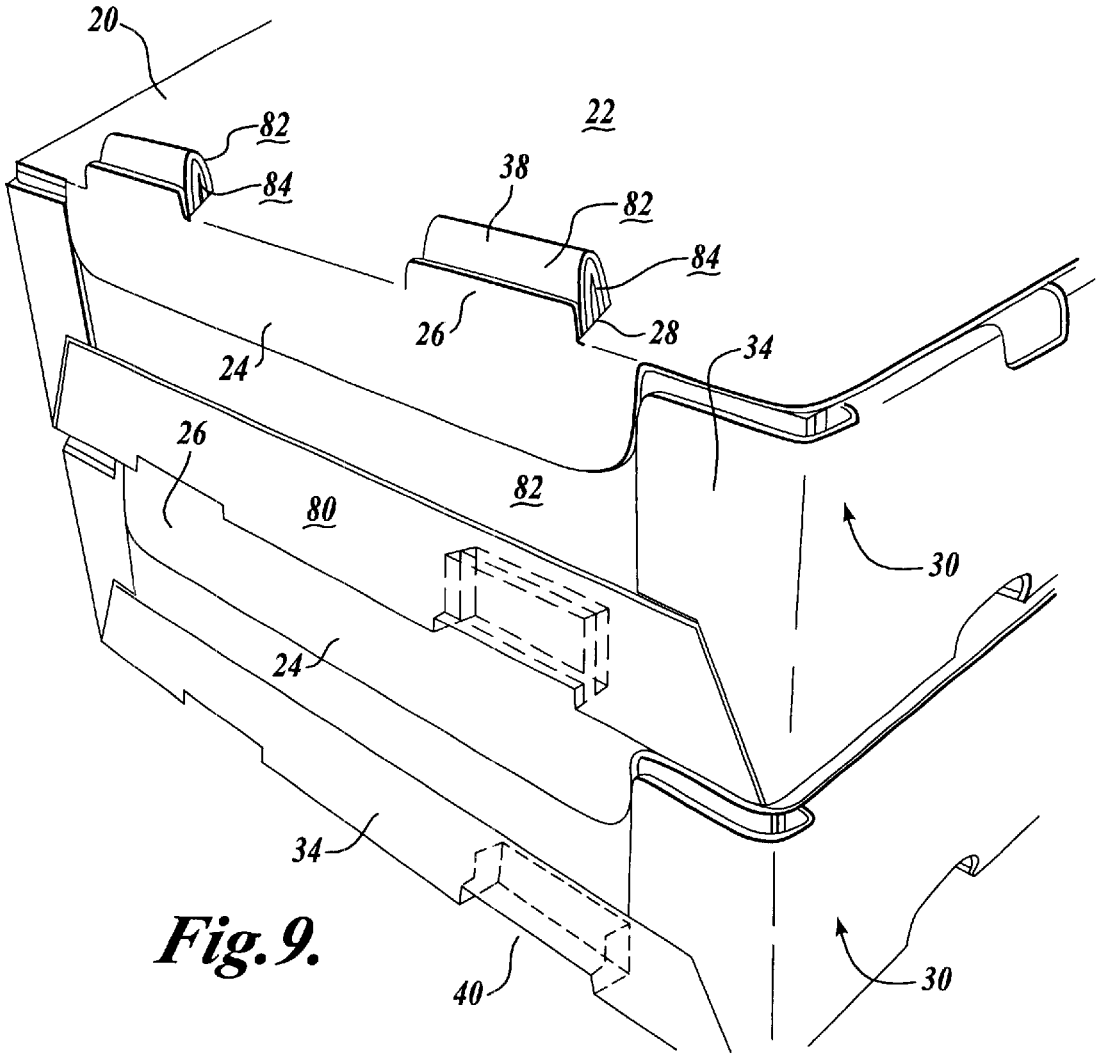
FIG. 9 is a perspective view of two stacked containers formed in accordance with the present invention.

In the particular embodiment of FIG. 9, the containment portion stacking tab 38 is of double-ply material thickness and the lid stacking tab 26 is of single-ply thickness. This results in a combined stacking tab of triple-ply material thickness. The containment portion upright wall 34 is made of three separate subpanels 80, 82, 84. As assembled, the lid stacking tab 26 is coplanar with the outermost subpanel 80. The containment portion stacking tab's double-ply material is coplanar with one or more of the other two subpanels 82, 84. The outermost receiving hole is approximately the same height as the lid stacking tab. The other two subpanel receiving holes are approximately the same height as the containment portion stacking tab. Depending on how the container is constructed, the receiving hole is also formed in the containment portion lateral panel in order to accommodate the increased stacking tab thicknesses. Alternatively, if the lid upright wall is positioned inward of the outermost subpanel, the receiving hole may be completely eliminated in the outermost subpanel. See, for example, the related embodiment shown in FIG. 10.

Figure 8:
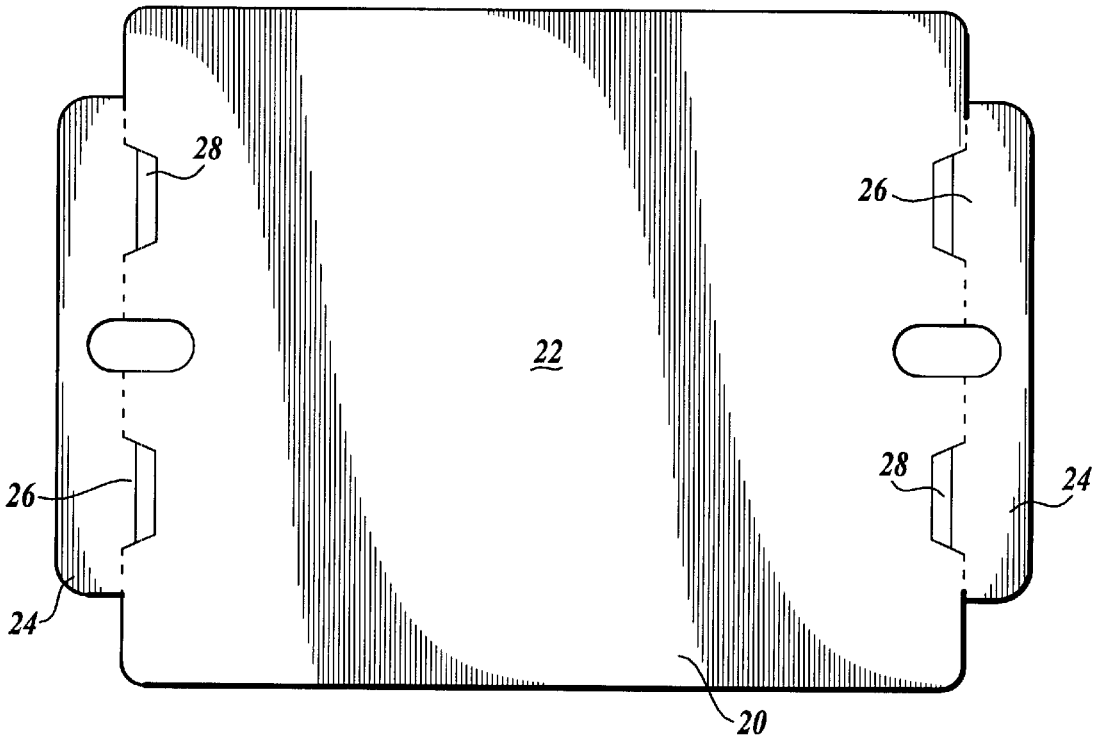
FIG. 8 is a plan view of yet another embodiment of a lid blank formed in accordance with the present invention.

What is important to this particular feature is the ability to insert, or trap, one or more of the stacking tabs inward of a containment portion upright wall. This enables the containment portion upright wall to act as a barrier to sideways motion of an adjacent stacked container. Similarly, the use of three or more stacking tab material layers increases the combined stacking tab's strength to resist lateral motion. For such thicknesses, it may be necessary to increase the lid opening. See FIG. 8, in which the cut defining the lid opening is larger than the lid stacking tab itself.

Figure 10:
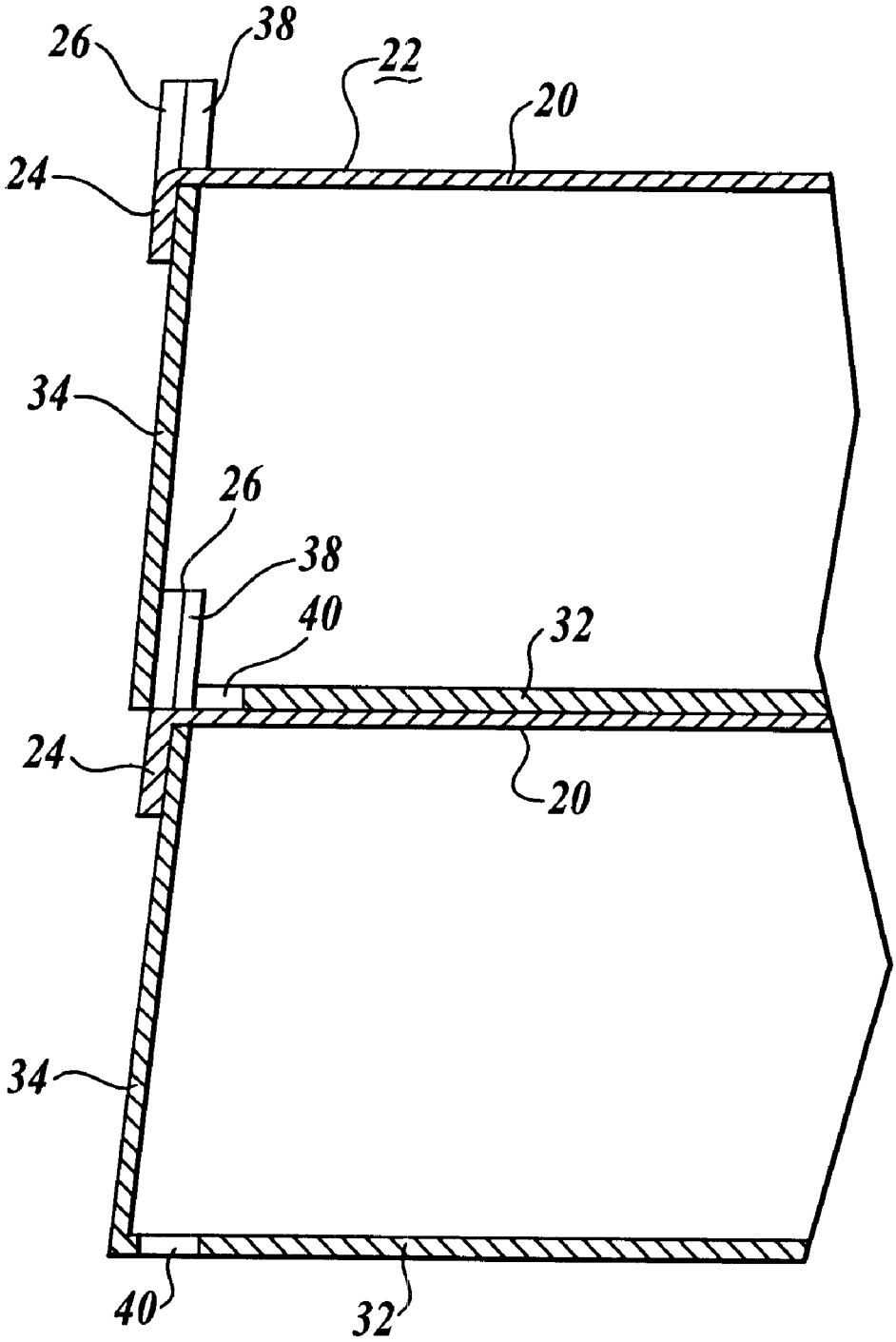
FIG. 10 is a side cross-sectional view of two further embodiments of stacked containers formed in accordance with the present invention.

Referring to the embodiment of FIG. 10, the container may be made with inwardly inclined upright walls. The receiving hole is preferably formed in only the containment portion lateral panel. This positions the combined stacking tabs inward of the adjacent containers' upright walls.

As will be appreciated from a reading of the above, the present invention offers a number of features useful for maintaining the alignment of adjacent stacked containers. These features are applicable to a number of currently known box designs and in some cases require little to no modification of the known containers. One of the advantages of the present invention is the ability to use such a lid without having to use adhesive between the lid upright wall and the containment portion upright wall. This greatly simplifies container production and enables the container to be easily reused. This arrangement is aided by use of an undercut in the lid lateral panel as described above.

As will be appreciated by those skilled in the art, the present invention is particularly applicable to open, or mostly open, display-ready trays, i.e., produce trays and the like, to provide protection for tray contents and to add structural integrity to the tray. The invention further strengthens the underportion of the tray and helps support trays stacked thereabove.

While the preferred embodiment of the invention has been illustrated and described, it will be appreciated that various changes can be made therein without departing from the spirit and scope of the invention. For example, the containers may be one of a number of styles, with any number of combined stacking tabs and corresponding receiving holes. The combined stacking tabs may be placed on side walls, end walls, or other adjoining surfaces. By way of further example, the lid may be ventilated, printed, embossed, or otherwise configured in a manner known to those skilled in the art.

The embodiments of the invention in which an exclusive property or privilege is claimed are defined as follows:

1. In a container having a containment portion and a lid; the containment portion having a lateral panel and an upright wall transverse to the containment portion lateral panel, the upright wall having an upper edge with a stacking tab provided therealong; the lid having a lateral panel and an upright wall hingedly connected to the lid lateral panel; an improvement comprising:

a lid stacking tab formed along the hinged connection between the lid upright wall and the lid lateral panel, the lid stacking tab being cut from portions of the lid lateral panel, the cut in the lid lateral panel providing an opening therethrough; the lid stacking tab being of the same size and shape as the containment stacking tab; and a receiving hole formed in the containment portion along the connection of its lateral panel and upright wall to receive at least portions of the combined stacking tab of an adjacent stacked container;

wherein to assemble, the lid upright wall is hinged away from the lateral panel, with the lid stacking tab remaining in the plane of the lid upright wall;

wherein as erected, the containment portion stacking tab is located within the lid opening and aligns with the lid stacking tab, the combination of the containment portion stacking tab and the lid stacking tab forming a combined stacking tab of at least double-ply material thickness.

2. The improvement according to claim 1, wherein the container includes plural combined stacking tabs as assembled.

3. The improvement according to claim 1, wherein the lid upright wall is an isolated flap.

4. The improvement according to claim 1, wherein the lid upright wall is maintained in an upright position without the use of adhesive between the lid upright wall and the containment portion upright wall.

5. The improvement according to claim 1, wherein the receiving hole is provided solely in the containment portion upright wall.

6. The improvement according to claim 5, wherein the combined stacking tabs are provided opposed along front and rear upper edges of the container.

7. The improvement according to claim 5, wherein the combined stacking tabs are provided along opposed upper side edges of the container.

8. The improvement according to claim 5, wherein the receiving hole is formed with the same size and shape as the containment portion stacking tab.

9. The improvement according to claim 8, wherein as assembled, the containment portion stacking tab is coplanar with the containment portion upright wall.

10. The improvement according to claim 1, wherein the receiving hole is provided in both the containment portion upright wall and the containment portion lateral panel.

11. The improvement according to claim 1, wherein the container includes a container stacking tab of double thickness and the lid includes a lid stacking tab of single thickness, thereby resulting in a combined stacking tab of three-layer thickness.

12. In a container having a containment portion and a lid; the containment portion having a lateral panel and an upright wall transverse to the containment portion lateral panel, the upright wall having an upper edge with a stacking tab provided therealong; the lid having a lateral panel and an upright wall hingedly connected to the lid lateral panel; an improvement comprising:

a lid stacking tab formed along the hinged connection between the lid upright wall and the lid lateral panel, the lid stacking tab being cut from portions of the lid lateral panel, the cut in the lid lateral panel providing an opening therethrough; and a receiving hole formed in the containment portion along the connection of its lateral panel and upright wall to receive at least portions of the combined stacking tab of an adjacent stacked container;

wherein the containment portion upright wall is formed of two subpanels, the lid upright wall being insertable between the two subpanels;

wherein to assemble, the lid upright wall is hinged away from the lateral panel, with the lid stacking tab remaining in the plane of the lid upright wall;

wherein as erected, the containment portion stacking tab is located within the lid opening, the combination of the containment portion stacking tab and the lid stacking tab forming a combined stacking tab of at least double-ply material thickness.

13. The improvement according to claim 12, wherein the lid stacking tab is of the same size and shape as the containment stacking tab.

14. The improvement according to claim 12, wherein the receiving hole is provided solely in the containment portion upright wall.

15. The improvement according to claim 12, wherein the receiving hole is provided in both the containment portion upright wall and the containment portion lateral panel.

16. The improvement according to claim 12, wherein the lid upright wall is maintained in an upright position without the use of adhesive between the lid upright wall and the containment portion upright wall.

17. The improvement according to claim 12, wherein the containment portion subpanels are connected by a bridge panel, the bridge panel forming the containment portion upright wall upper edge, the bridge panel including a slot at the location of the containment portion stacking tab for receiving the lid upright wall.

18. The improvement according to claim 16, wherein the lid upright wall is an isolated flap.

19. The improvement according to claim 12, wherein the container includes a container stacking tab of double thickness and the lid includes a lid stacking tab of single thickness, thereby resulting in a combined stacking tab of triple-ply material thickness.

20. In a container having a containment portion and a lid; the containment portion having a lateral panel and an upright wall transverse to the containment portion lateral panel, the upright wall having an upper edge with a stacking tab provided therealong; the lid having a lateral panel and an upright wall hingedly connected to the lid lateral panel; an improvement comprising:

a lid stacking tab formed along the hinged connection between the lid upright wall and the lid lateral panel, the lid stacking tab being cut from portions of the lid lateral panel, the cut in the lid lateral panel providing an opening therethrough; the lid stacking tab being of a first height, the containment stacking tab being of a second height; the first height being less than the second height; and a receiving hole formed in the containment portion upright wall along the connection of its lateral panel and upright wall to receive at least portions of the combined stacking tab of an adjacent stacked container, the receiving hole being of a third height, the third height being less than the second height;

wherein to assemble, the lid upright wall is hinged away from the lateral panel, with the lid stacking tab remaining in the plane of the lid upright wall;

wherein as erected, the containment portion stacking tab is located within the lid opening, the combination of the containment portion stacking tab and the lid stacking tab forming a combined stacking tab of at least double material thickness, wherein as inserted into an adjacent container, the additional height of the containment portion stacking tab is available to push outward against the adjacent containment portion upright wall.

21. The improvement according to claim 20, wherein the receiving hole is provided in both the containment portion upright wall and the containment portion lateral panel, the portion of the receiving hole in the containment upright wall being of a height at least as great as the first height and less than the second height.

22. The improvement according to claim 21, wherein as assembled, the lid stacking tab is received in the receiving hole portion located in the containment upright wall, and the containment portion stacking tab is positioned interior to the lid stacking tab.

23. The improvement according to claim 20, wherein the receiving hole is provided solely in the containment portion lateral panel, as assembled, the lid stacking tab being positioned exterior to the receiving hole and the containment portion stacking tab being positioned within the receiving hole.

24. The improvement according to claim 20, wherein the containment portion upright wall is formed of an exterior subpanel and an interior subpanel, the exterior subpanel having the third height and the interior subpanel having a fourth height at least as great as the second height.

25. The improvement according to claim 20, wherein the lid upright wall is maintained in an upright position without the use of adhesive between the lid upright wall and the containment portion upright wall.

26. The improvement according to claim 20, wherein the receiving hole is provided solely in the containment portion lateral panel.

27. The improvement according to claim 26, wherein the container upright walls are inwardly inclined to aid in inserting the combined stacking tabs into the receiving holes of an adjacent container.

28. In a container having a containment portion and a lid; the containment portion having a lateral panel and an upright wall transverse to the containment portion lateral panel, the upright wall having an upper edge with a stacking tab provided therealong; the lid having a lateral panel and an upright wall hingedly connected to the lid lateral panel; an improvement comprising:

a lid stacking tab formed along the hinged connection between the lid upright wall and the lid lateral panel, the lid stacking tab being cut from portions of the lid lateral panel, the cut in the lid lateral panel providing an opening therethrough; and a receiving hole formed in the containment portion along the connection of its lateral panel and upright wall to receive at least portions of the combined stacking tab of an adjacent stacked container;

wherein the containment stacking tab is of at least two-ply material thickness, the width of the lid opening being larger than the height of the lid stacking tab to accommodate the additional thickness of containment portion stacking tab material;

wherein to assemble, the lid upright wall is hinged away from the lateral panel, with the lid stacking tab remaining in the plane of the lid upright wall;

wherein as erected, the containment portion stacking tab is located within the lid opening and aligns with the lid stacking tab, the combination of the containment portion stacking tab and the lid stacking tab forming a combined stacking tab of at least triple-ply material thickness.

29. The improvement according to claim 28, wherein the lid upright wall is maintained in an upright position without the use of adhesive between the lid upright wall and the containment portion upright wall.

30. The improvement according to claim 28, wherein the lid stacking tab and the containment portion stacking tabs are of the same height.

* * * * *